United States Patent [19]

Gordon et al.

[11] 4,314,638

[45] Feb. 9, 1982

[54] SHIPPING CONTAINER DESIGNED TO PREVENT CAN DAMAGE DUE TO CHIME RIDE

[75] Inventors: Robert L. Gordon, Monroe, N.Y.; Paul Z. Wolak, Kingston, Mich.

[73] Assignee: International Paper Company, New York, N.Y.

[21] Appl. No.: 250,452

[22] Filed: Apr. 2, 1981

[51] Int. Cl.[3] ..... B65D 81/02; B65D 65/00

[52] U.S. Cl. ..... 206/427; 206/594; 220/405; 220/440

[58] Field of Search ..... 206/427; 434, 521, 586, 206/591, 594; 220/405, 440; 229/37

[56] References Cited

U.S. PATENT DOCUMENTS

| | | | |
|---|---|---|---|
| 2,001,850 | 5/1935 | Patterson, Jr. | 229/37 |
| 2,031,254 | 2/1936 | Derr | 206/591 |
| 2,979,246 | 4/1961 | Liebeskind | 206/591 |
| 2,998,129 | 8/1961 | Bekins | 206/591 |
| 3,291,370 | 12/1966 | Elias | 229/37 |
| 3,598,233 | 8/1971 | Jasinover | 229/37 |
| 3,990,576 | 11/1976 | Heaney | 206/594 |
| 4,194,678 | 3/1980 | Jasper | 229/37 |

*Primary Examiner*—Joseph Man-Fu Moy
*Attorney, Agent, or Firm*—Jay S. Cinamon

[57] ABSTRACT

A shipping container for lidded, chimed cans designed to avoid "chime ride" and consequent damage to the can bodies is achieved by reverse folding the major and minor flaps forming the bottom wall and top wall of a regular slotted container and providing a one-piece corrugated pad between the bottom surface of the chimed cans and the inner surface of the bottom wall to form a rigid platform for the cans.

2 Claims, 6 Drawing Figures

FIG. 4
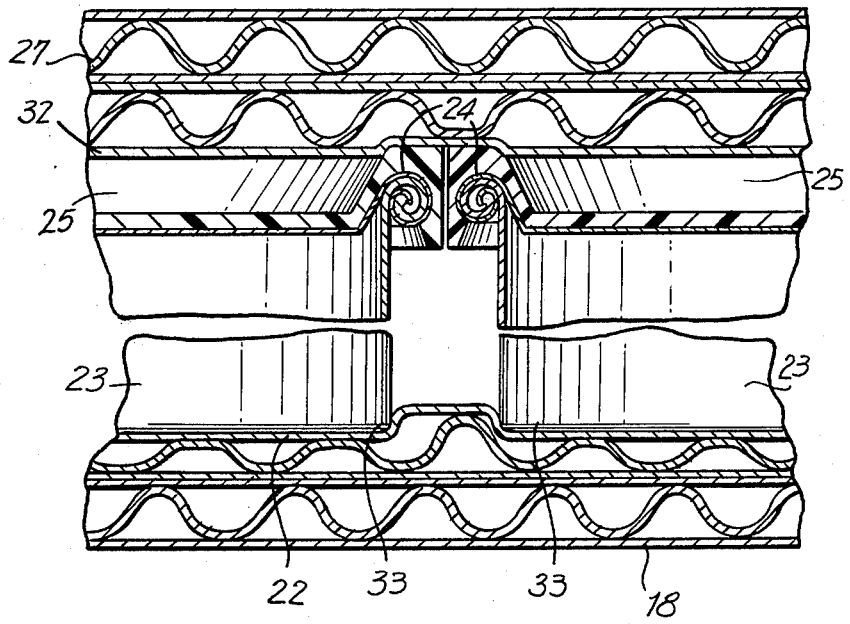
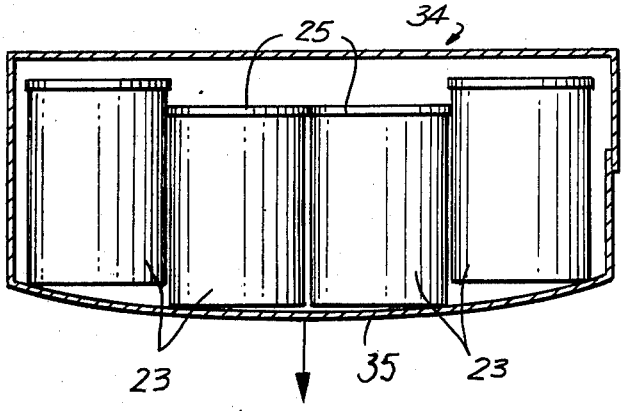
FIG. 5
FIG. 6
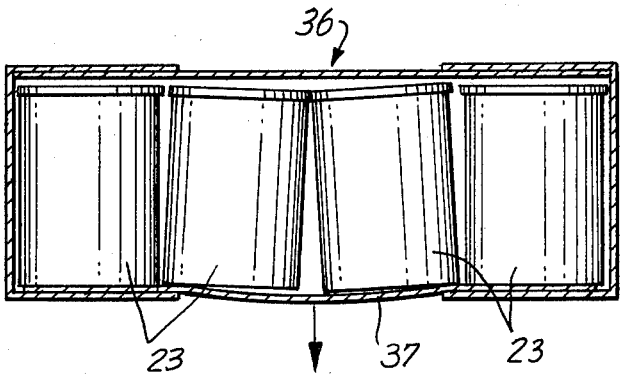

SHIPPING CONTAINER DESIGNED TO PREVENT CAN DAMAGE DUE TO CHIME RIDE

BACKGROUND OF THE INVENTION

1. Field of the Invention

This invention relates to a container for the shipment of goods and, more particularly, to a corrugated shipping container which is especially adapted for the shipment of goods contained in lidded, chimed cans made of paperboard.

2. Description of the State of the Art

The chime of a can is the protruding rim or edge which circumscribes either the top or bottom surface of a can, or occassionally both such surfaces. In many instances a plastic lid is applied to the top of a chimed can in order to facilitate reclosure of the can after it has been opened, for example, a coffee can. When lidded, chimed cans are packed for shipment in flat-bottomed shipping containers, the lids of adjacent cans abut each other, but the can bodies do not touch. Accordingly, if the shipping container's bottom wall sags under the weight of the load, or if the shipping container is tilted or dropped on edge during transit or handling, which invariably occurs, the lid of one can will move horizontally and drop beneath the level of the lid of the adjacent can causing contact between the lid and the can body resulting in a dent to the body of the adjacent can. A cost-effective solution to this problem, which is referred to in the packaging art as "chime ride", has proven extremely elusive.

One solution has been to insert corrugated partitions in the container to isolate each can in the array to avoid denting contact. This solution is far from satisfactory, however, since it is both cost- and labor-intensive.

The need to find a more cost-effective solution, and which is also less labor-intensive, has been accentuated with the advent of lighter weight materials, such as paperboard, being used in the manufacture of cans since the risk of damage to a paperboard can body due to "chime ride", to the point where it is unsuitable for sale, is greater than with a metal can. The problem is particularly acute with resealable cans made of paperboard, which are sealed with a breakable membrane and a reuseable overcap or lid. In this type of can, a relatively small dent will result in the inner seal being broken, thereby causing contamination of the product, which may be foodstuffs, or possibly escape or loss of product from the can. The use of lids or overcaps with large paperboard curled chimes has contributed markedly to the likelihood of such denting occuring because of the relatively larger diameter of such lids.

SUMMARY OF THE INVENTION

It is, accordingly, an object of the present invention to provide an economical shipping container for chimed cans, having lids or overcaps, which will prevent "chime ride" and avoid the consequent damage to the can bodies during transit.

This object and other objects of the invention are achieved by reverse folding the major and minor flaps forming the bottom wall and top wall of a regular slotted corrugated shipping container and providing a one-piece corrugated pad between the bottom surface of the chimed cans and the inner surface of the bottom wall to form a rigid platform for the cans. Preferably, a corrugated pad is also provided between the top surface of the chimed cans and the inner surface of the top wall, especially in those instances where the cans are laden with a heavy product or the shipping container is subject to being inverted during shipment. Since the interior height of the erected container, i.e., the height of a side wall, must be somewhat less than the combined height of a lidded, chimed can and either one or two corrugated pads, a compression fit is created within the container when it is closed sufficient to depress the fluting within the corrugated pad(s) and cause the pad(s) to conform to and assume the configuration of the bottom and top of the can. By this means the bottom wall of the container is prevented from sagging since horizontal movement of the cans relative to one another, resulting in "chime ride", is avoided.

BRIEF DESCRIPTION OF THE DRAWINGS

FIG. 4 is a cross-sectioned view taken along line 4—4 of FIG. 3.

FIG. 5 is a sectional view similar to FIG. 3 of a wrap-around case.

FIG. 6 is a sectional view similar to FIG. 3 of a reverse folded container without the corrugated pad(s) of the present invention.

DETAILED DESCRIPTION OF THE INVENTION

Figure 1:
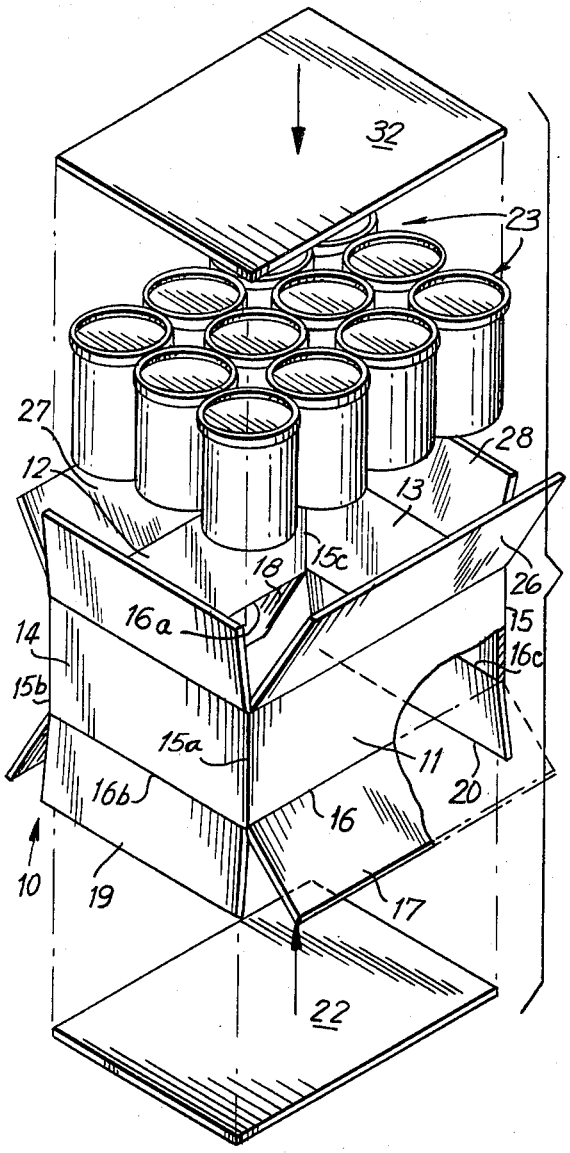
FIG. 1 is a exploded view of the container of the present invention.
Figure 2:
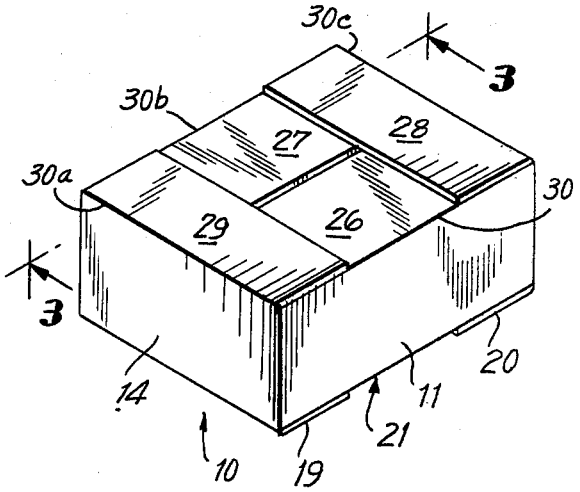
FIG. 2 is a perspective view of the assembled container.
Figure 3:
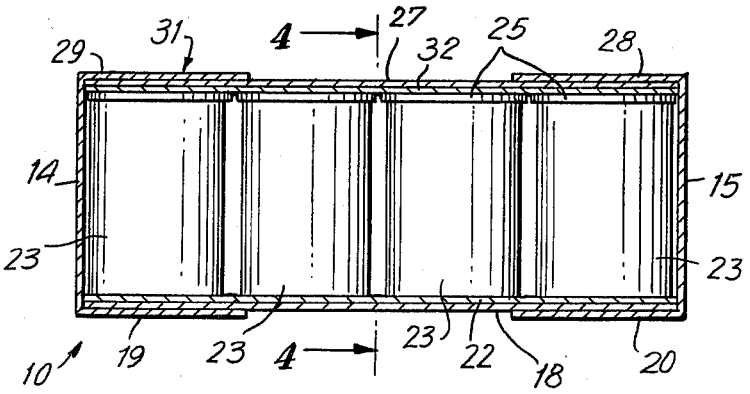
FIG. 3 is a cross-sectioned view taken along line 3—3 of FIG. 2.

Referring to FIGS. 1, 2, 3, the container 10 of the present invention, which is preferably formed from corrugated paperboard, comprises side walls 11 and 12 and end walls 13 and 14 hingedly connected about vertical score lines 15, 15*a*, 15*b* and 15*c*. Hingedly connected to the bottom edges of side walls 11 and 12 about horizontal score lines 16, 16*a* are a first pair of major flaps 17 and 18. Hingedly connected to the bottom edges of end walls 13 and 14 about horizontal score lines 16*b* and 16*c* are a first pair of minor flaps 19 and 20.

During erection of the container 10, which can be accomplished by automatic case packaging machines or manually, bottom wall 21 is formed first by folding major flaps 17 and 18 downwardly and inwardly into a substantially perpendicular attitude with respect to side walls 11 and 12. The next step in forming the bottom wall 21 involves folding the first pair of minor flaps 19 and 20 downwardly and inwardly into a substantially perpendicular attitude with respect to end walls 13 and 14. Minor flaps 19 and 20 are then secured to the outer surfaces of the first pair of major flaps 17 and 18 by either gluing, stitching, or stapling, or any other convenient securing means. Thus, the major flaps 17 and 18, which normally comprises the outermost face of the container's bottom wall, now lie above the minor flaps 19 and 20 since they have been "reverse folded". This reverse folding sequence of the major and minor flaps provides a flat platform which imparts added strength to the container's bottom wall, as will be discussed in greater detail later.

In one embodiment of the present invention, a single, one-piece corrugated pad 22 is sandwiched between and in abutting contact with the inner surface of bottom wall 21, formed by major flaps 17 and 18, and a plurality of lidded, chimed cans 23, arranged, as depicted, in an array or configuration of three rows of four cans each. The cans 23, can have various shapes, such as cylindrical, oval, square with radius corners, etc. They are top loaded into the container and are seated upon the upper surface of corrugated pad 22. Other arrangements of the cans be employed, such as, for example, six rows of four cans each. The cans 23, as shown in FIGS. 1, 3 and 4, have chimes 24 circumscribing their top surfaces and lids 25 surmounting the chimes and engaged therewith. The lids or overcaps can be made of low density polyethylene or polypropylene or other suitable materials.

After the lidded, chimed cans 23 have been loaded, a second pair of major flaps 26, 27 and a second pair of minor flaps 28, 29 are also reverse folded, about horizontal score lines 30, 30*a*, 30*b* and 30*c*, in the same manner as was previously described with respect to the first pairs of major and minor flaps, to form top wall 31 of the container 10.

Alternatively, in another embodiment of the present invention, prior to the second pairs of major and minor flaps being reverse folded, a second corrugated pad 32 is inserted into position atop the lidded, chimed cans 23 and is sandwiched in abutting contact therewith and with the inner surface of top wall 31, formed by major flaps 24 and 25. The use of an upper corrugated pad provides added strength and rigidity at the upper end of the container, beyond that attainable by the lower corrugated pad alone, and is especially desirable in those instances where an extra heavy load is being transported or where a shipping container is subject to being inverted during the transit cycle.

By employing the reverse folding sequence to form the bottom and top walls of the container 10, complemented by the presence of the lower corrugated pad 22 in abutting contact with the bottom wall 21, or both a lower and upper corrugated pad in abutting contact with the inner surfaces of both the bottom and top walls, and which are also in face-contacting relationship with both surfaces or ends of the lidded, chimed cans, as illustrated in FIGS. 3 and 4, a platform is formed which maintains the cans in an upright, vertical attitude and prevents horizontal movement of the cans relative to one another.

The maintenance of the vertical attitude of the chimed cans and the avoidance of horizontal movement of the cans relative to one another, is also achieved by virtue of the fact that the interior height of the container, as measured along side wall 11, must be slightly less than the combined height of a single lidded, chimed can 23 and a single corrugated pad. In those instances where an upper corrugated pad is also employed, along with the lower corrugated pad, the interior height of the container must be slightly less than the combined height of a lidded chimed can and two corrugated pads. Thus, during transit, the bottom surface 33, of the paperboard can 23, is firmly embedded in the resilient corrugated pads 22 and compresses and deforms the fluting of the pad 22, as can be seen by reference to FIG. 4. The upper corrugated pad 32 is also compressed against the lidded surface 25 and the corrugated pad is depressed into the recess in the lid's surface. This type of compression fit between the lidded surface and the bottom surface of the cans and the corrugated pads, augmented by the rigidity provided by the reverse folded major flaps, results in a container construction having remarkable load stabilizing ability, so that horizontal and vertical movement of the cans relative to one another is minimized even when the container is dropped from heights of up to two feet.

FIGS. 5 and 6 depict the problems attendant the use of prior container constructions for the shipment of lidded, chimed cans. FIG. 5 illustrates the situation where the chimed cans 23 are end loaded into a wrap-around case 34. Since in this type of package there are no major or minor flaps and there is no corrugated pad, the two middle cans move downwardly relative to the cans on either end when bottom wall 35 of the wrap-around case 34 sags. This results in the lids 25 of the two middle cans coming into denting and damaging contact with the bodies of the end cans.

FIG. 6 illustrates the situation where no corrugated pad is present in the container. Thus, even in those instances where the lidded, chimed cans 23 are top loaded into a regular slotted shipping container 36, and the major and minor flaps of the bottom and top walls are reverse folded, as shown in FIG. 6, the bottom wall 37 will sag, in the area where the flaps are reversed, due to the fact that there is no corrugated pad present to prevent movement of the cans and consequent sagging of the container.

The specific and detailed information presented above was for the purpose of illustration only, and such alterations, modifications, and equivalents thereof as would suggest themselves to those skilled in the art are deemed to fall within the scope and spirit of the invention, bearing in mind the invention is defined by the following claims.

What is claimed is:

1. A shipping container for a plurality of lidded, chimed cans, which comprises (a) hingedly connected pairs of side and end walls;

(b) a bottom wall comprising a first pair of major flaps hingedly connected to the ends of the side walls and extending substantially perpendicular thereto and a first pair of minor flaps hingedly connected to the ends of the end wall and extending substantially perpendicular thereto and secured to the outer surfaces of the first pair of major flaps;

(c) a lower corrugated pad positioned in abutting contact with the inner surfaces of the first pair of major flaps;

(d) a plurality of lidded, chimed cans seated atop the corrugated pad;

(e) a top wall comprising a second pair of major flaps hingedly connected to the side walls at their other ends and extending substantially perpendicular thereto and a second pair of minor flaps hingedly connected to the end walls at their other end and extending substantially perpendicular thereto and secured to the outer surfaces of the second pair of major flaps;

(f) the interior height of said container being less than the combined height of a lidded, chimed can and the lower corrugated pad creating a compression fit whereby the combination of the corrugated pad and the first pair of major flaps forms a rigid platform which maintains the cans in an upright position while avoiding bottom wall sag, caused by horizontal movement of the cans relative to one another, and damage due to chime ride.

2. A shipping container in accordance with claim 1 and including an upper corrugated pad positioned in abutting contact between the inner surface of the top wall and the lidded, chimed cans.

* * * * *